US006089638A

United States Patent [19]

Whitnell

[11] Patent Number: 6,089,638

[45] Date of Patent: Jul. 18, 2000

[54] STABILIZED TWO-CUP CARRIER

[75] Inventor: Simon Whitnell, Exton, Pa.

[73] Assignee: Dopaco, Inc., Exton, Pa.

[21] Appl. No.: 09/192,358

[22] Filed: Nov. 16, 1998

[51] Int. Cl.[7] ..... B65D 75/00

[52] U.S. Cl. ..... 294/159; 206/175; 206/180; 229/117.14; 229/120.18

[58] Field of Search ..... 294/159, 87.1, 294/87.2; 206/143, 170, 175, 180, 185, 188, 193, 198; 229/117.12, 117.13, 117.14, 120.18, 904

[56] References Cited

U.S. PATENT DOCUMENTS

| | | | |
|---|---|---|---|
| 2,543,821 | 3/1951 | Arneson . | |
| 2,771,232 | 11/1956 | Reed | 294/159 |
| 2,800,250 | 7/1957 | Buttery . | |
| 2,821,328 | 1/1958 | Ramsay . | |
| 2,942,756 | 6/1960 | Collura et al. . | |
| 2,959,323 | 11/1960 | Petek . | |
| 3,090,539 | 5/1963 | Dorofachuk | 229/117.14 |
| 3,158,286 | 11/1964 | Phillips, Jr. . | |
| 3,394,863 | 7/1968 | Wood et al. . | |
| 3,703,982 | 11/1972 | Daughtry | 229/117.12 |
| 4,157,755 | 6/1979 | Gough . | |
| 4,610,349 | 9/1986 | Schwartz et al. . | |

*Primary Examiner*—Dean J. Kramer
*Attorney, Agent, or Firm*—Dennison, Scheiner, Schultz & Wakeman

[57] ABSTRACT

A handled foldable paperboard carrier is disclosed that includes peripheral walls defining an upwardly opening basket and a closed bottom joined to and extending between the walls. Stabilizers cooperate with the bottom to form a support base for the carrier, which stabilizers extend laterally outward from the walls and have base edges substantially coplanar with the bottom.

11 Claims, 2 Drawing Sheets

STABILIZED TWO-CUP CARRIER

BACKGROUND OF THE INVENTION

In the fast food industry in particular, it is common to provide carriers, conventionally formed of folded paperboard or cardboard, to accommodate multiple beverage cups and the like. Such carriers, in addition to allowing for the convenient carrying of multiple cups, will also function as a holder for cups upon a placing of the carrier on a table, counter top, or the like.

However, beverage cups have become increasingly larger in recent years, and the ability of the conventional handled carrier to handle the larger cups is less than satisfactory. While this is not particularly noticeable in carriers adapted to contain more than a single row of drinking cups, for example four cups in a square carrier, the problem is particularly acute with regard to 2-cup carriers with the cups aligned within a narrow carrier of a transverse width approximately that of the width of the received cups. A degree of lateral stability can result from a perfectly planar base on the carrier and a perfectly planar support surface, tabletop or the like. However, as the height of the cups increases, particularly as the conventional cup will normally increase in diameter upward from a narrow lower end, the problems of maintaining lateral stability to the carrier will also increase.

It is to be appreciated that while carriers of the type involved herein are referred to as cup carriers, the word cup is intended to encompass equivalent beverage containers such as soda or beer bottles and cans, juice jars, and the like.

SUMMARY OF THE INVENTION

The 2-cup carrier of the invention is folded from paperboard and includes a basket portion with two longitudinally aligned upwardly opening cup compartments and a central transverse partition and handle therebetween. While similar in appearance to a conventional carrier, the carrier of the invention differs significantly therefrom in providing for a substantial increase in lateral stability.

It is of particular importance that the improvements in the carrier are achieved without an increase in the amount of material used in the carrier, with only minimal changes in the manufacturing procedures and with no changes in the manner of use of the carrier particularly with regard to the manner in which the carrier is unfolded from its collapsed storage position to its in-use position.

Basically, the carrier, which is one cup wide and two cups long, includes, as in the conventional carrier, two longitudinally extending side walls and two relatively shorter transverse end walls with a transverse partition, parallel to the end walls and intermediate thereof, joined to and extending between the side walls to divide the carrier into two longitudinally aligned upwardly opening compartments.

The stability of the carrier is achieved by forming outriggers or stabilizers directly from the longitudinal wall panels of the blank which, upon an unfolding of the carrier to its in-use position, extend substantially coplanar with the end walls and laterally beyond the side walls. At least two such outriggers are provided, one extending beyond each longitudinal wall at opposite ends of the carrier.

These outriggers, with lower bottom substantially coplanar with the generally planar base of the basket portion of the carrier, provide an enlarged effective base, substantially greater than merely the bottom of the basket portion, which extends laterally beyond the basket portion to effectively resist any tendency for a lateral tipping of the cup-containing carrier.

Further features and details of the invention will become apparent from the more specific description following hereinafter.

DESCRIPTION OF PREFERRED EMBODIMENTS

Figure 1:
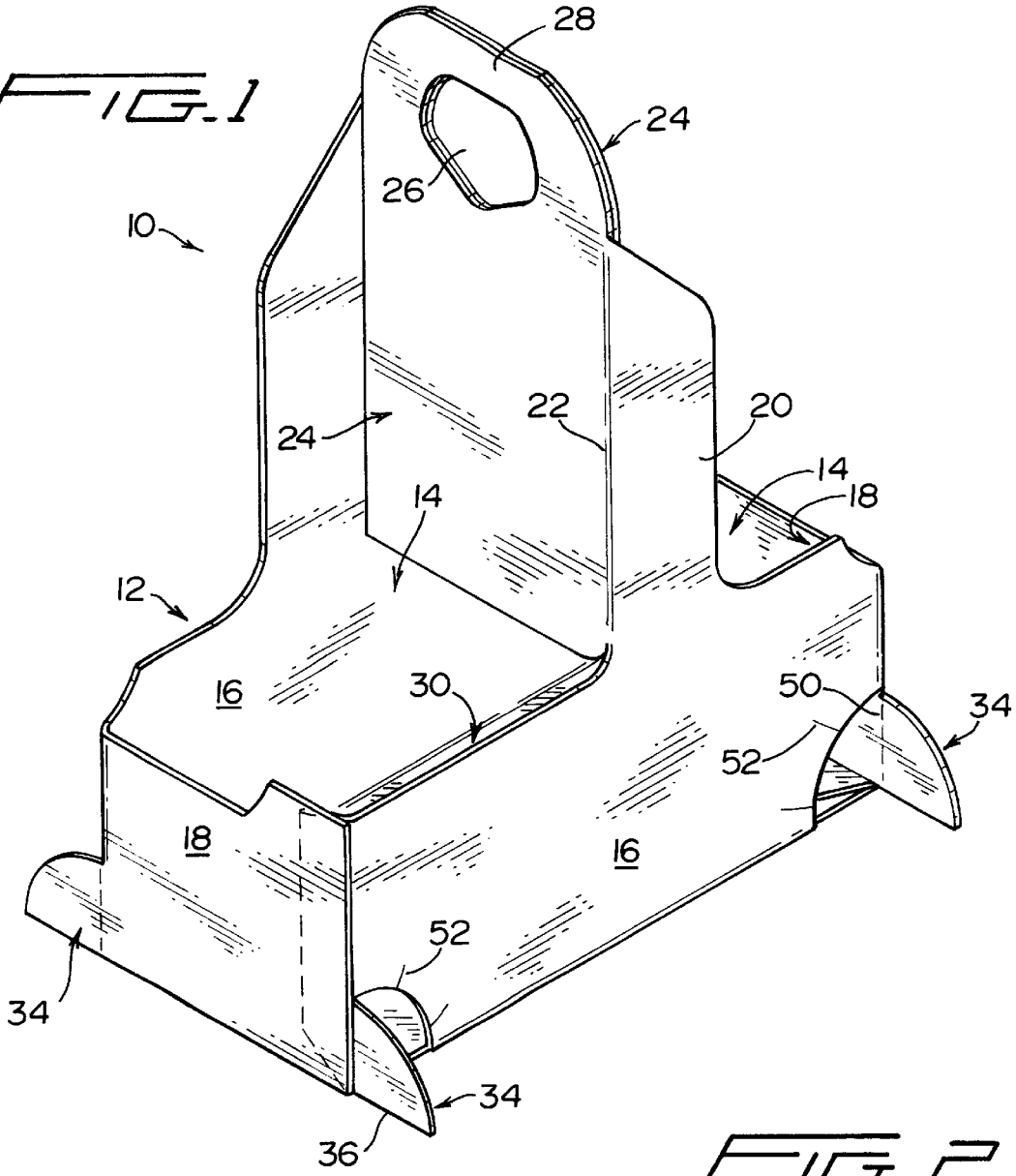
FIG. 1 is a top perspective view of the carrier of the invention utilizing four stabilizers.

Referring now more specifically to the drawings, the carrier 10 is a 2-cup carrier comprising an upwardly opening basket portion 12 formed with two longitudinally aligned compartments 14.

The basket portion is of an elongate preferably rectangular configuration having laterally spaced parallel longitudinal walls 16 and transverse parallel end walls 18.

The side walls 16 each include a coplanar vertical wall extension 20 extending vertically above the basket portion 12. The two extensions 20 are offset toward opposite end walls 18 and include, along fold-line defined inner edges 22 thereof, laterally extending partition panels 24 which are in face-to-face engagement with each other and extend across the carrier centrally of the length thereof and immediately above the basket portion 12 to combine therewith in defining the compartments 14. The partition panels 24 are preferably bonded to each other and, at the upper portion thereof, have aligned transverse apertures 26 therethrough to define a hand grip 28. The joined partition panels 24 parallel the end walls 18 centrally therebetween and, with the side wall extensions 20 extending partially along the outer edge portions of the side walls 16, provide a balanced and strengthened means for carrying two beverage containers in the two normally equally sized compartments 14.

The carrier 10 will preferably be provided with a rather conventional self-erecting bottom 30 formed of a plurality of overlapping flaps 32 which are so interrelated as to erect into a substantially flat or planar bottom upon an opening of the carrier 10 from its folded stored position. Basically, in the folded position of the carrier 10, and with reference to FIG. 1, the forwardmost side and end panels 16 and 18 will be shifted to the right relative to the rearmost side and end panels with the basket portion folding at the vertical corners thereof and the partition panels 24 folding at the vertical edge fold lines 22, all as in a conventional 2-cup carrier.

In order to enhance the stability of the carrier 10, lateral outwardly directed stabilizers 34 are provided at the four corners thereof. Each of the stabilizers, when extended, are coplanar or substantially coplanar with a corresponding end wall 18 and extend laterally outward from and beyond the corresponding side walls 16. Each stabilizer 34 is of an arcuate configuration with a straight base edge or edge surface 36 substantially coplanar with the bottom 30. These stabilizers 34 act in the manner of outriggers and effectively increase the planar base of the carrier 10 by approximately two-thirds. Thus, there is a substantial increase in the lateral stability of the carrier and an effective resistance to any tendency for a lateral tipping of the loaded carrier. This is increasingly significant in accommodating cups or beverage containers of substantial height.

Figure 2:
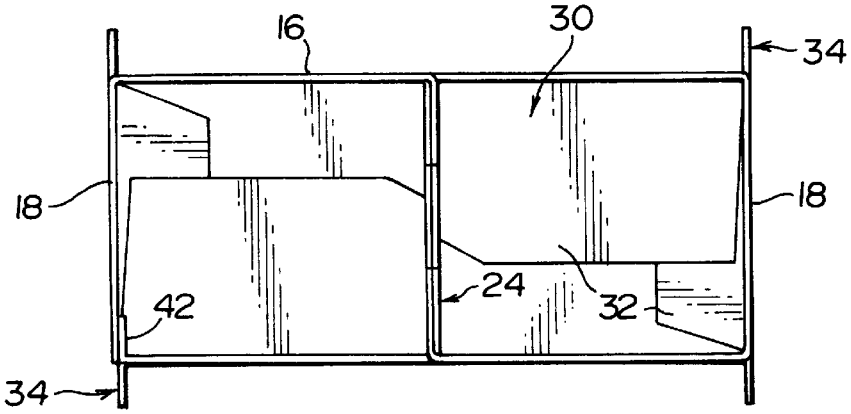
FIG. 2 is a top plan view thereof.
Figure 3:
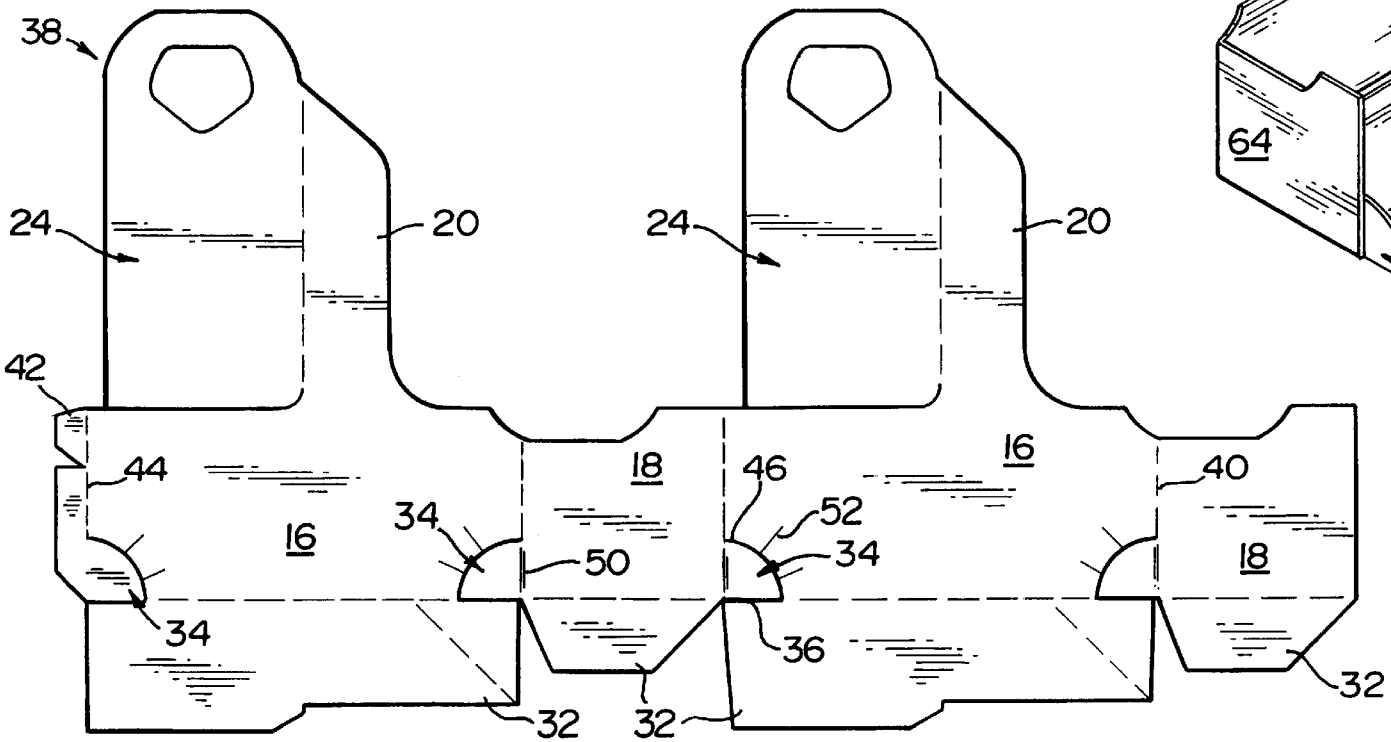
FIG. 3 is a plan view of the unitary blank from which the carrier is formed.

Noting FIG. 3, the carrier is formed from a single unitary blank 38 with the side and end walls 16 and 18 alternating along the length thereof and integrally joined at transverse fold lines 40. The leftmost side wall 16 in FIG. 3 has a flap 42 integrally formed therewith along fold line 44. This glue flap 42, noting the top plan view of FIG. 2, is, in the erected carrier, adhesively bonded to the inner face of the adjoining end panel 18 with the fold line 44 forming one of the vertical corner edges of the carrier basket. The side wall extensions 20 and the partition panels 24, in the blank 38, project upward from the upper edges of the side walls 16, and the bottom flaps 32 depend from the lower edges of both the side walls 16 and end walls 18.

The stabilizers 34, with continued reference to the blank 38, are defined by arc-shaped segments formed in the opposed lower corners of the side walls 16 as integral coplanar extensions of the end walls 18 and the glue flap 42 by arcuate cut lines 46 extending from the transverse fold lines 40 and 44 and the fold lines 48 which define the lower edges of the side walls 16 between the side wall 16 and the bottom flaps 32.

In the carrier 10, when folded for shipping and storage and prior to erection into the position of FIG. 1, the stabilizers 34 will lie coplanar with the side walls 16. A first pair of diametrically opposed stabilizers 34 will form rigid extensions of the corresponding end walls 18 and will automatically outwardly fold into their projecting positions upon an unfolding of the carrier 10. These automatically unfolding stabilizers will, in the illustrated embodiment, comprise the stabilizer integral with the glue flap 42 and the stabilizer diametrically opposed therefrom. In order to facilitate this automatic opening of these two stabilizers 34, the arcuate edges thereof will be completely severed from the side wall 16.

The second diametrically opposed pair of stabilizers 34 will each have a fold line 50 along the inner edge thereof adjacent the corresponding edge of the corresponding end wall 18 to allow for an inward folding of the stabilizers into the planes of the corresponding side walls 16 and will thus require a slight manual manipulation to project the stabilizers in the erected carton. As desired, the foldable pair of stabilizers 34 can, along the arcuate edges thereof, have a tear line for a positive retention of the folded stabilizers until required. In other words, depending upon the load within the carrier, if the two rigid stabilizers are sufficient, the second pair of stabilizers need not be used. As a further alternate, the folded stabilizers can in fact be formed rigid with the associated end walls 18, in which case, the stabilizers will extend longitudinally beyond the folded carrier at each end thereof. While this is possible, it is not particularly desirable both for storing and shipping purposes and the likelihood that the stabilizers could be damaged.

In order to facilitate the outward folding of all four stabilizers 34, short radial slits 52 extend outward from the arcuate cut or tear lines 46 providing for a slight degree of increased flexibility in the side walls 16 to avoid any possible frictional resistance to the free outward swinging of the stabilizers as desired.

Figure 4:
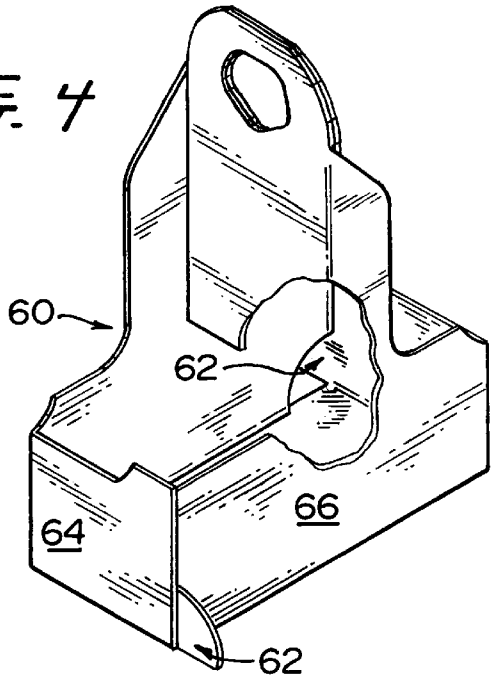
FIG. 4 is a reduced perspective view of a variation of the carrier using only two stabilizers.

FIG. 4 illustrates a variation wherein the carrier 60 differs from the carrier 10 in that only two stabilizers 62 are provided. These stabilizers 62 are at the diametrically opposed corners of the basket portion of the carrier and are rigid with and extend coplanar from the corresponding end walls 64. The stabilizers 62 are defined from the adjoining side walls 66 and, in the folded carrier, nest coplanar within the side walls 66 until such time as the stabilizers automatically extend upon an unfolding of the carrier to the position of FIG. 4.

The foregoing is illustrative of the principles of the invention. While these principles have been illustrated in conjunction with two embodiments, it is to be appreciated that other embodiments as may fall within the scope of the claims following hereinafter are also contemplated.

What is claimed is:

1. A compartmented carrier for beverage containers comprising opposed side walls and opposed end walls extending between and joining said side walls, a substantially planar bottom joined to said side and end walls and combining therewith to define an upwardly opening carrier basket, partition means extending between selected ones of said walls for forming multiple upwardly opening compartments in the carrier, a support base for said carrier, said base comprising said bottom and projecting stabilizers joined to selected ones of said walls along a line normal to the plane of said base and extending laterally outward of selected ones of said walls.

2. The carrier of claim 1 wherein said basket is rectangular.

3. A compartmented carrier for beverage containers comprising opposed side walls and opposed end walls extending between and joining said side walls, a substantially planar bottom joined to said side and end walls and combining therewith to define an upwardly opening carrier basket, partition means extending between selected ones of said walls for forming multiple upwardly opening compartments in the carrier, a support base for said carrier, said base comprising said bottom and protecting stabilizers joined to selected ones of said walls and extending laterally outward of selected ones of said walls with a surface of each stabilizer being substantially coplanar with said bottom, wherein said stabilizers comprise first and second stabilizers respectively substantially coplanar with said opposed end walls and extending respectively laterally beyond said opposed side walls at a first pair of diametrically opposed corners of said basket defined by said end walls and said side walls.

4. The carrier of claim 3 wherein said stabilizers include third and fourth stabilizers generally coplanar with said end walls and extending laterally beyond said side walls at a second pair of diametrically opposed corners formed by said end walls and said side walls.

5. A handled foldable paperboard carrier comprising peripheral walls defining an upwardly opening basket, said basket including a closed bottom joined to and extending between said walls, a support base comprising said bottom and stabilizers substantially coplanar with and extending laterally outward of selected ones of said walls and including base edges substantially coplanar with said bottom.

6. A handled foldable paperboard carrier comprising peripheral walls defining an upwardly opening basket, said basket including a closed bottom joined to and extending between said walls, a support base comprising said bottom and stabilizers extending laterally outward of selected ones of said walls and including base edges substantially coplanar with said bottom wherein said walls include opposed parallel side walls and opposed parallel end walls extending between and joining said side walls to form a rectangular configuration for said basket, said stabilizers being defined from and outwardly folded from said side walls to extend generally coplanar with said end walls at at least two diametrically opposed corners formed between said side walls and end walls.

7. The carrier of claim 6 wherein said stabilizers also extend from two additional diametrically opposed corners defined by said side walls and said end walls.

8. A foldable paperboard blank for use in the formation of a two compartment carrier, said blank comprising four longitudinally joined wall panels with transverse fold lines between adjacent panels, said panels having upper and lower edges, bottom panels integral with said wall panels along said lower edges with fold lines defined between said wall panels and said bottom panels, said wall panels comprising a first side wall panel and a first end wall panel at opposed longitudinal ends of said blank, and a second side wall panel and a second end wall panel respectively inward of and adjoining said first end wall panel and said first side wall panel, said second side wall panel and second end wall panel having adjoining edges, stabilizer panels formed in each side wall panel with a cut line defining each stabilizer panel and extending partially along said lower edge of each side wall panel for a selective outward projection of said stabilizer panels relative to said side wall panels.

9. The blank of claim 8 wherein two stabilizer panels are defined in each side wall panel.

10. The blank of claim 9 wherein said first side wall panel has an outer edge with a glue flap integral therewith and foldable relative thereto along a fold line defined between said first side wall panel and said glue flap, said stabilizer panels including a first stabilizer panel coplanar and rigid with said glue flap and extending inward of said first side wall panel relative to said glue flap beyond said fold line between said first side wall panel and said glue flap, a second one of said stabilizer panels extending from said second end wall panel into said second side wall panel beyond said fold line between said second end wall panel and said second side wall panel for coplanar folding with said second end wall panel.

11. The blank of claim 8 wherein said first side wall panel has an outer edge with a glue flap integral therewith and foldable relative thereto along a fold line defined between said first side wall panel and said glue flap, said stabilizer panels including a first stabilizer panel coplanar and rigid with said glue flap and extending inward of said first side wall panel relative to said glue flap beyond said fold line between said first side wall panel and said glue flap, a second one of said stabilizer panels extending from said second end wall panel into said second side wall panel beyond said fold line between said second end wall panel and said second side wall panel for coplanar folding with said second end wall panel.

* * * * *